United States Patent [19]

Chrisley

[11] Patent Number: 4,593,426

[45] Date of Patent: Jun. 10, 1986

[54] LITTER COLLECTION APPARATUS

[75] Inventor: Barney D. Chrisley, Centerville, Va.

[73] Assignee: Caravelle Industries, Inc., Manassas, Va.

[21] Appl. No.: 554,970

[22] Filed: Nov. 25, 1983

[51] Int. Cl.[4] ..... E01H 1/00

[52] U.S. Cl. ..... 15/84; 56/328 R; 56/364; 171/63; 298/11; 414/488

[58] Field of Search ..... 15/82–87, 15/54, 55, 340; 56/328 R, 364; 171/63; 198/698, 699; 298/10, 11; 414/488

[56] References Cited

U.S. PATENT DOCUMENTS

| | | | |
|---|---|---|---|
| 983,405 | 2/1911 | Scheidler et al. | 15/84 |
| 1,053,233 | 2/1913 | Shira | 15/84 |
| 1,239,293 | 9/1917 | Murphy | 15/84 |
| 2,199,703 | 5/1940 | Hough | 15/84 |
| 2,327,879 | 8/1943 | Farrar | 15/84 |
| 2,679,133 | 5/1954 | Soderholm | 56/328 R |
| 2,809,743 | 10/1957 | Hinchcliffe | 198/699 |
| 2,917,761 | 12/1959 | Burgdorff | 15/84 |
| 3,186,015 | 6/1965 | Beyerstedt | 15/84 |
| 3,447,179 | 6/1969 | Copeland | 15/84 |
| 3,552,108 | 1/1971 | Kattan | 56/328 R |
| 3,588,937 | 6/1971 | Scruggs et al. | 15/84 |
| 4,343,060 | 8/1982 | Hildebrand et al. | 15/84 |
| 4,363,151 | 12/1982 | Knowlton | 15/83 |
| 4,550,465 | 11/1985 | Chrisley . | |

*Primary Examiner*—Edward L. Roberts

*Attorney, Agent, or Firm*—Birch, Stewart, Kolasch & Birch

[57] ABSTRACT

A litter collection apparatus includes a novel arrangement for mounting litter retrieving projections on a retrieving belt of the apparatus, an improved receptacle and mechanism for emptying the receptacle, a novel arrangement for adjustably positioning the apparatus with respect to a surface over which it passes and an improved drive arrangement for the respective components of the apparatus.

34 Claims, 12 Drawing Figures

LITTER COLLECTION APPARATUS

FIELD OF THE INVENTION

The present invention relates to apparatus for automatically removing litter from a surface and disposing of such litter.

BACKGROUND OF THE INVENTION

Collecting litter from public areas, such as parks, highways, etc. is a troublesome task. Often it is necessary to collect such litter manually, picking up each piece individually and placing it in a collection bag or the like. Such a procedure is labor-intensive, time-consuming and relatively expensive.

Accordingly, an object of the invention is to provide apparatus which will rapidly and efficiently collect litter and dispose of such litter.

Particularly, an object of the invention is to provide a highly efficient apparatus for retrieving litter strewn across a wide area and for rapidly and efficiently disposing of such litter.

It is a further object of this invention to provide such an apparatus which includes features facilitating maintenance and reducing operating costs.

A specific object of the invention is to provide reliable drive means for automatic litter collection apparatus. A further object is to provide such drive means which are easily incorporated into such an apparatus.

SUMMARY OF THE INVENTION

A litter collection apparatus in accordance with the invention comprises support means, means for facilitating movement of the apparatus across a surface, litter retrieval means on the support means for removing litter from the surface, a receptacle for receiving litter from the retrieval means, the receptacle comprising a first opening and a movable closure over the first opening, the receptacle further including a second opening for receiving litter from the retrieval means, the second opening being devoid of closure means, and emptying means for causing the litter to be removed from the receptacle through the first opening. The second opening is maintained in an uppermost position on the receptacle, whereby litter will not be spilled therefrom during the emptying operation. The closure over the first opening automatically opens by gravitational force during the emptying procedure.

In another aspect of the invention, the litter collection apparatus includes means for adjustably mounting the litter retrieval means on the support frame of the apparatus whereby the retrieval means may be moved toward or away from the surface. The adjustable support means includes a flexible support member and a lifting means mounted on the support frame for moving the retrieval means. The litter retrieval means may include a roll and a conveyor cooperable with the roll. The adjustable support means serves to position both the roll and the conveyor with respect to the surface.

In another aspect, the litter collection apparatus of the invention comprises a plurality of projections on the conveyor portion of the retrieval means. The projections are held against a first surface of the conveyor belt by holding members. The projections comprise a shaft and an enlarged base portion, the holding members comprising means for holding the base portion against the first surface of the belt. In a preferred embodiment, a single holding member retains a plurality of the projections on the conveyor belt.

Apparatus in accordance with the invention includes first means for driving the roll and conveyor of the retrieval means and second means for driving means for emptying the litter receptacle of the device. Hydraulic power supply means are provided for supplying power to the first and second means. The first and second means are movably mounted on the frame of the apparatus, flexible connecting means extending between the hydraulic power supply means and the first and second means. The hydraulic power supply means includes a pump having separate pumping sections associated with respective drive motors of the apparatus.

BRIEF DESCRIPTION OF THE DRAWINGS

The invention and objects thereof will be best understood in view of the following description taken together with the accompanying drawings in which.

DETAILED DESCRIPTION OF A PREFERRED EMBODIMENT

Figure 1:
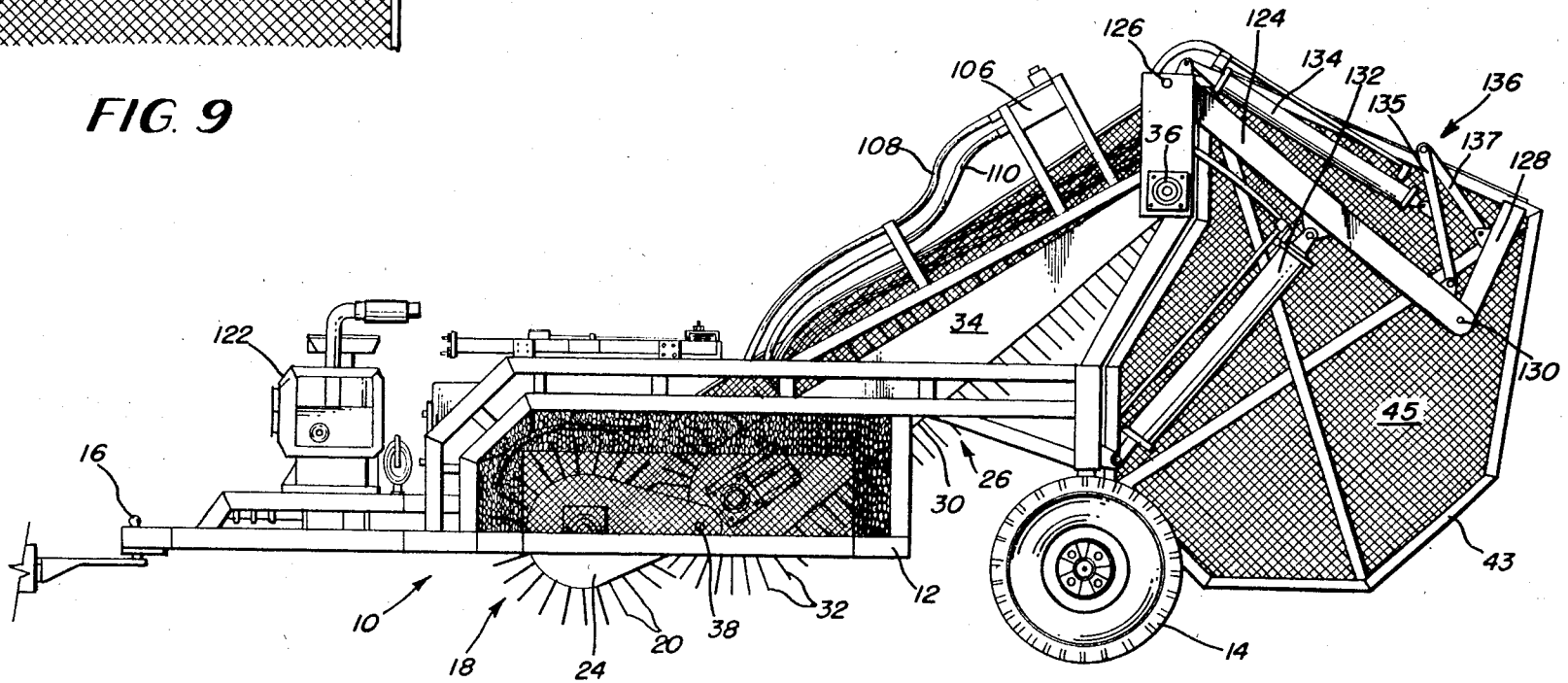
FIG. 1 is a side elevational view of an apparatus in accordance with the invention.
Figure 2:
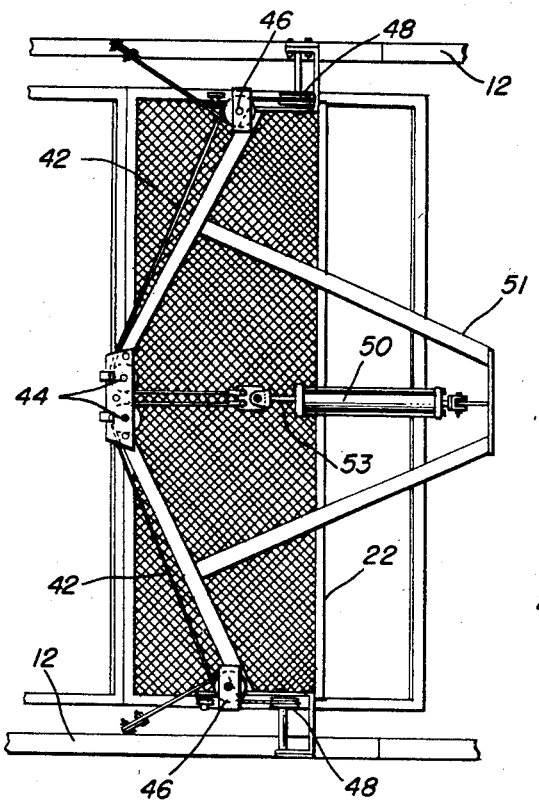
FIG. 2 is a partial top view of the apparatus of FIG. 1.
Figure 3:
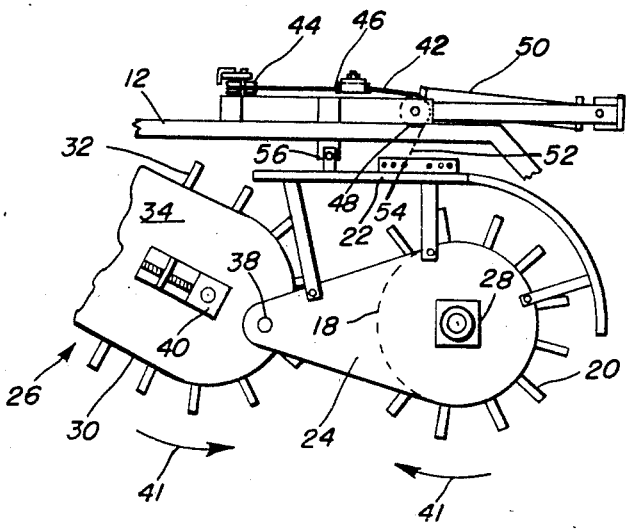
FIG. 3 is a side view of the portion of the apparatus shown in FIG. 2.

Referring to FIGS. 1–3, a litter collection apparatus in accordance with the present invention is illustrated, designated generally by reference numeral 10. The apparatus comprises a frame 12 supported at one end thereof by wheels 14 and having a hitch 16 at the other end thereof for attachment to a towing vehicle. While the invention is disclosed herein as a device to be towed behind another vehicle, it is within the scope of the invention to provide litter collection apparatus supported by a self-powered vehicle.

For retrieving litter from a surface over which the apparatus passes, the apparatus includes a front roll 18, which may be formed from, for example, PVC pipe. Roll 18 comprises a plurality of projections 20 arranged in rows spaced circumferentially about the roll. The manner in which these projections function will be described in greater detail hereinafter.

Roll 18 is supported in a carriage frame 22 which includes a pair of side plates 24. Roll 18 is adjustable toward and away from a conveyor 26, to be described below, by adjustable bearing mounts 28.

Conveyor 26 includes a continuous belt 30 having a plurality of projections 32 thereon. Projections 32 will also be described in greater detail hereinafter. Conveyor 26 is supported by a conveyor frame 34. One end of conveyor frame 34 is pivotally supported by bearings 36 mounted on an upper end of frame 12 of the apparatus. The opposite end of conveyor frame 34 is pivotally attached to side plates 24 of carriage frame 22 by pivotal connectors 38. A front conveyor roll, to be described below, is supported by a pair of adjustable bearing mounts 40, whereby the tension in the conveyor belt may be adjusted.

In operation, roll 18 and conveyor belt 30 are driven in opposite directions, as indicated by arrows 41 and 41', shown in FIG. 3. Projections 20 and 32 intermesh with each other as the roll and belt pass adjacent one another. As the apparatus passes over litter strewn about a surface, the projections contact the litter and propel it upwardly through the gap between roll 18 and conveyor belt 30. Conveyor 30 thereafter carries the litter upwards into receptacle 43, as will be described in greater detail below.

In order to properly retrieve litter from a surface, projections 20 and 32 must pass closely adjacent to the surface. For this purpose, means are provided for adjustably positioning roll 18 and conveyor 26 with respect to frame 12, and thus with respect to a surface over which the apparatus travels. Cables 42 pass around a pair of top pulleys 44 and around side pulleys 46, as shown in FIGS. 2 and 3. The cables then pass around a pair of vertical pulleys 48 disposed at each side of the apparatus. The cables 42 are connected at one end to a lifting ram 50 supported by frame members 51. Preferably, as will be discussed in detail below, lifting ram 50 is hydraulically powered.

At their opposite ends, cables 42 are attached to opposite sides of carriage frame 22, as shown in FIG. 3. Thus, when a piston arm 53 of ram 50 is extended or retracted, carriage frame 22 is lowered or raised.

As discussed above, conveyor frame 34 is pivotally connected to side plates 24 of carriage frame 22 by pivots 38. Thus, while one end of conveyor frame 34 is supported by bearings 36, the other end of the conveyor is supported by the carriage frame which is in turn supported by cables 42. Thus, as cables 42 are manipulated by ram 50, carriage frame 22 and conveyor frame 34 move in an arcuate path about the axis of mounts 36. Portions 52 of cables 42 extend between pulleys 48 and points 54 where the cables are attached to the carriage frame. Points 54 are spatially related to pulleys 48 in such manner that cable portions 52 extend in a direction which is substantially tangential to the arcuate path followed by carriage frame 22 and conveyor frame 34. Additionally, the weight supported by cables 42, such weight comprising the carriage frame 22 and the lower end of conveyor 26, is balanced about points 54. Consequently, as cables 42 are manipulated by ram 50, roll 18 and the lower end of conveyor 26 move upwardly or downwardly to the same extent and thereby remain at a common level. As a result, both roll 18 and conveyor 26 can be jointly lowered or raised to position both the roll and the conveyor at proper positions equidistant from a surface.

This represents a substantial improvement over known devices which employ rigid pistons and the like for raising and lowering similar components. The combination of the front roll 18 and conveyor 26 is self-leveling, requiring only simple tension members for support and adjustment. Such support and adjustment means are simple, reliable, and inexpensive. Little or no maintenance is required.

An additional support means 56 is provided for supporting carriage frame 22 and conveyor 26 during transport of the apparatus of the invention. Support means 56 may comprise, for example, means for bolting or hooking the carriage frame to a support means associated with frame 12. This relieves the stress on cables 42 during transport of the apparatus.

Figure 4:
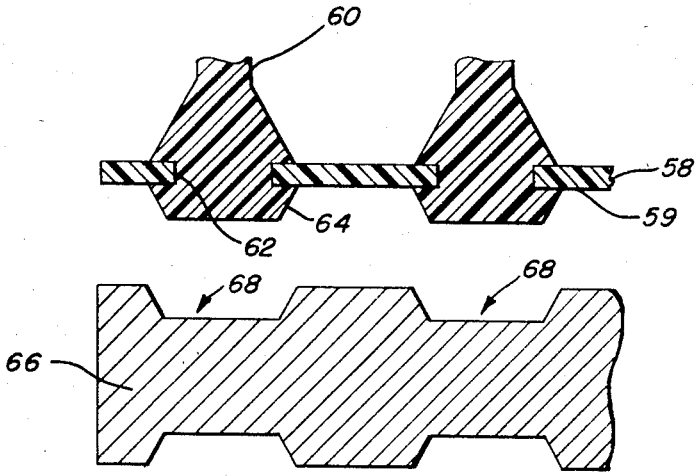
FIG. 4 PRIOR ART
FIG. 4 illustrates a conveyor belt typically employed in previously known litter retrieving devices.

FIG. 4 is a sectional view of a known variety of conveyor belt 58 which might be used in the manner of conveyor belt 30 of the present invention. Belt 58 supports a plurality of projections 60 which are used for picking up litter, in a manner as described above. Typically, projections 60 are mounted within a plurality of holes 62 in belt 58. An enlarged portion 64 retains each projection within its respective aperture. Reference numeral 66 refers to a roll which supports a conveyor belt as shown in FIG. 4. Due to the presence of enlarged portions 64 protruding beyond surface 59 of belt 58, a corresponding number of grooves 68 must be provided in roll 66 to permit belt 58 to pass thereover. Since a relatively wide belt comprises many columns of projections 60, a significant number of grooves is required, increasing the cost of rolls 66 and generally weakening the structure of such rolls. Additionally, it is somewhat difficult to attach and detach a projection 60 associated with a belt 58 as shown in FIG. 4.

The present invention overcomes these disadvantages by providing novel means for attaching projections to conveyor belt 30. Such means are illustrated in FIGS. 5A, 5B and 6.

As noted above, belt 30 of the invention supports a plurality of projections 32. Projections 32 may be formed, for example, from urethane, may typically be 1 inch in diameter and approximately 11–12 inches in total length. Each projection 32 comprises an enlarged flange or base 70. The projections are held against belt 30 by members 72, which may have a channel configuration as best seen in FIG. 5B. Each member 72 includes at least one aperture 74 for accomodating a reinforced enlarged neck portion 76 of projection 32. Flange 70 is retained against the belt by the portion of member 72 adjacent aperture 74. One or more bolts or other fasteners 78 pass through belt 30 and retain holding channels 72, and thus projections 32, against the belt. As shown in FIG. 6, in a preferred embodiment, a plurality of channels 72 each retain a row of projections on the belt, each row extending across the direction of travel of belt 30. In the embodiment illustrated, each row comprises 17 projections.

Figure 5A:
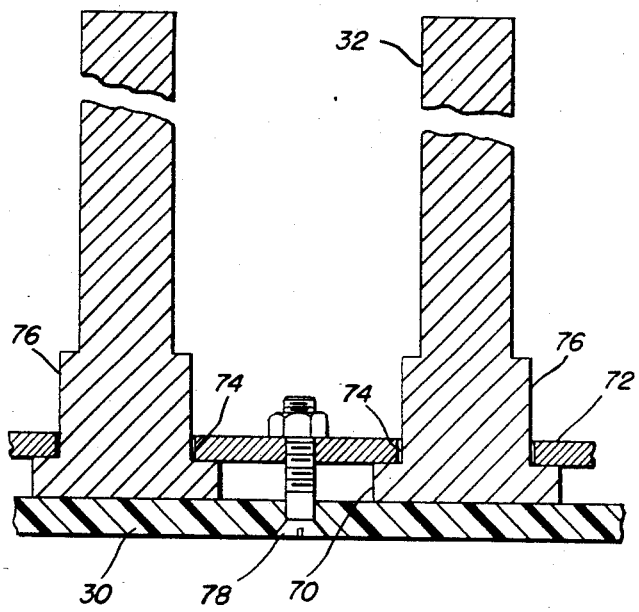
FIGS. 5A and 5B are sectional views of a conveyor belt and associated projections and holding means in accordance with the invention.
Figure 5B:
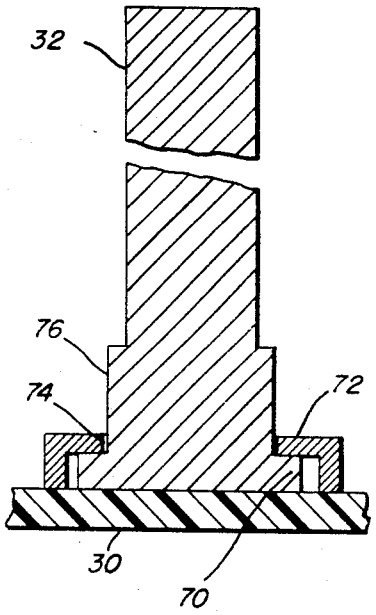

As is evident from FIGS. 5A and 5B, no portion of projections 32 extend to the underside of belt 30. The underside is therefore smooth and unobstructed. Consequently, it is not necessary to provide numerous grooves in a conveyor support roll, as previously noted with reference to FIG. 4.

Figure 6:
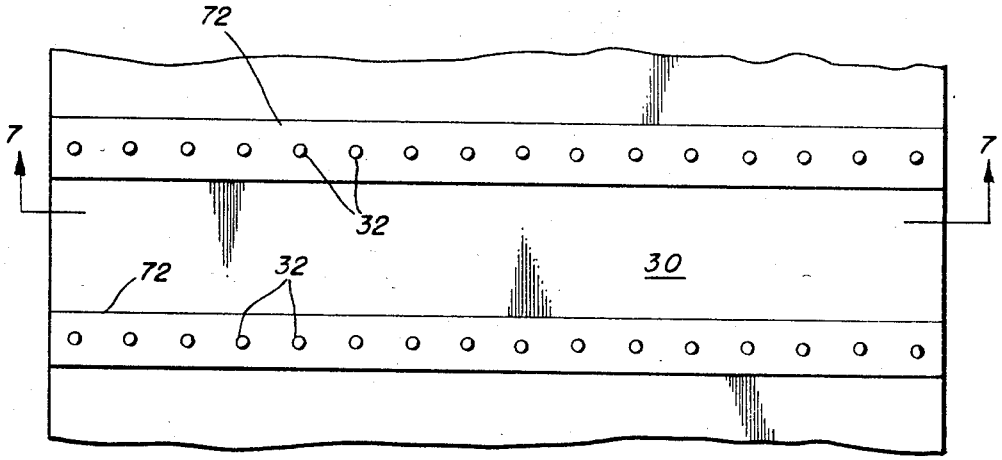
FIG. 6 is a plan view of a portion of a conveyor belt in accordance with the present invention.
Figure 7:
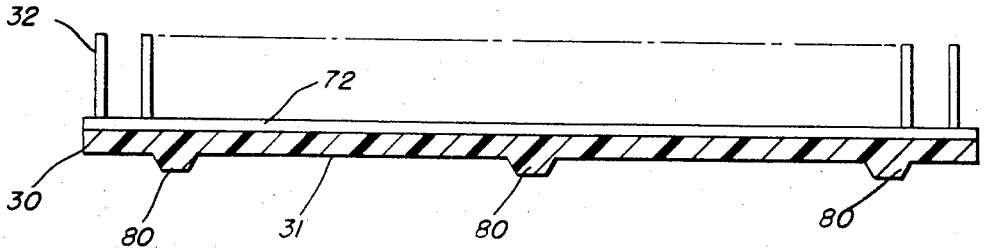
FIG. 7 is a sectional view along line 7—7 of FIG. 6.
Figure 8:
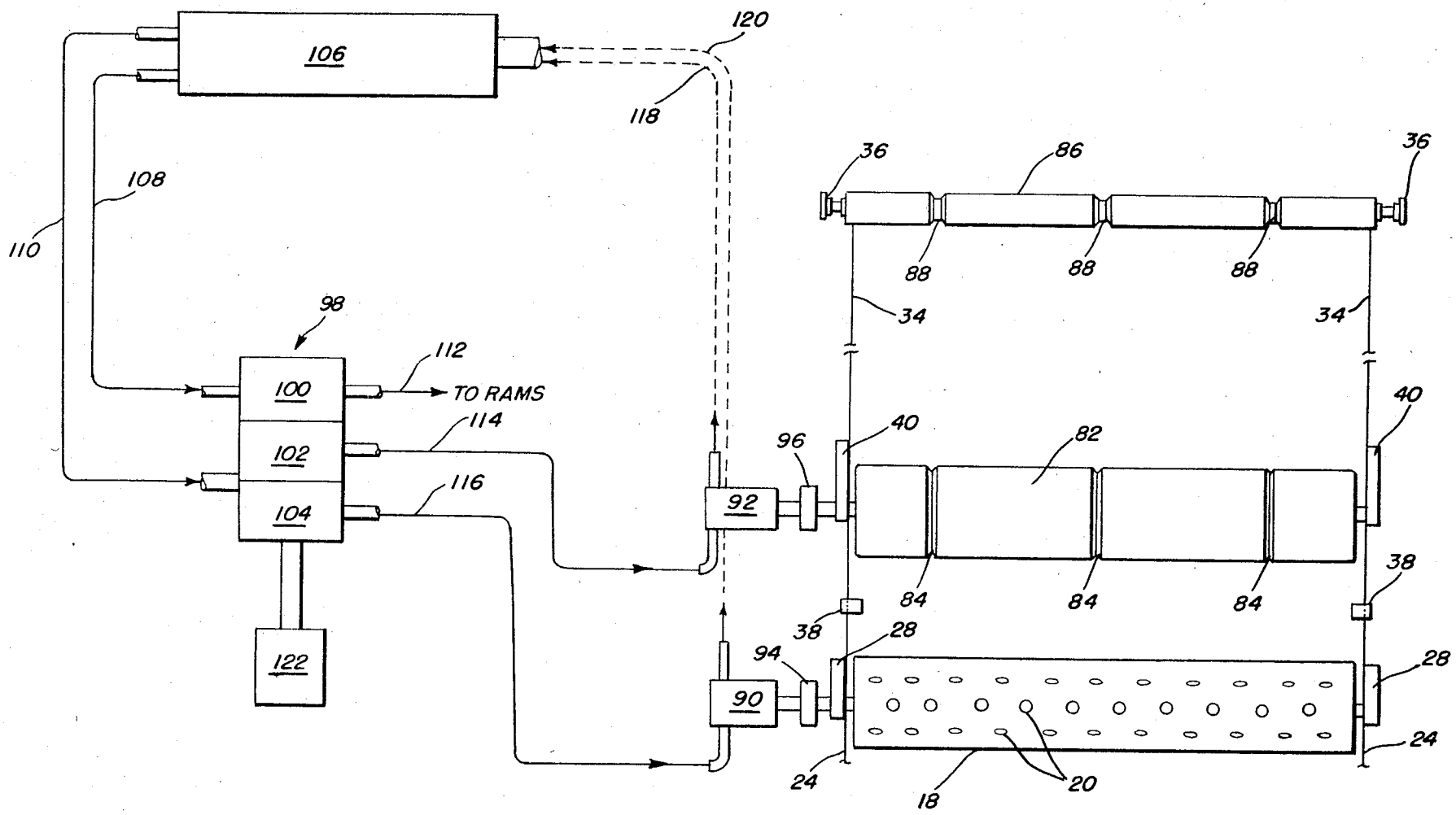
FIG. 8 is a schematic illustration of various components of the inventive apparatus, including the drive means therefor.

FIG. 7 is a sectional view of conveyor belt 30 along line 7—7 of FIG. 6, illustrating a preferred embodiment of the conveyor belt in accordance with the present invention. While the underside 31 of conveyor belt 30 is, for the most part, smooth and free of obstruction, it is desirable to attach, for example by vulcanization, one or more V-belts 80 to belt 30. A corresponding few grooves (84, 88 as shown in FIG. 8) are provided in conveyor support rolls. The V-belts 80 and corresponding grooves stabilize the belt on the support rolls and enhance traction for driving the belt.

The combination of belt 30, projections 32 and holding members 72 in accordance with the invention offers a number of advantages over previously known similar combinations. Initially, as discussed above, the configuration of belt 30 is such that simpler, stronger, and less expensive support and driving rolls may be provided for the conveyor. Belt 30 itself may be manufactured at a lower cost as compared to a belt as illustrated in FIG. 4. The manner in which projections 32 are retained on belt 30 by members 72 facilitates quick and rapid exchange of worn or broken projections, and also facilitates exchanging all projections 32 for projections of a different size, if such is desired. An additional advantage is that projections 32 enjoy a limited degree of freedom of movement within holders 72. Therefore, should a projection encounter an obstruction or heavy object during operation of the apparatus, it may deflect to a limited degree, avoiding breakage and undue wear.

FIG. 8 schematically illustrates a number of components of the present apparatus, including the novel drive system associated therewith. Elements corresponding to previously described parts of the apparatus are identified with like reference numerals.

As is best seen in FIG. 8, front roll 18 comprises a plurality of rows of projections 20. Alternate adjacent rows have, for example, 17 or 18 projections arranged axially of the roll.

Apparatus in accordance with the invention includes a front conveyor roll 82, supporting conveyor belt 30 at the lower end thereof adjacent front roll 18. Front conveyor roll 82 includes one or several V-grooves 84 for cooperating with V-belts 80, as previously described. A rear conveyor roll 86 comprises a corresponding number of V-grooves 88 for a like purpose.

A front roll drive motor 90 is provided for rotatably driving front roll 18. Motor 90 is preferably hydraulically operated. A separate hydraulic conveyor drive motor 92 is provided. Motors 90 and 92 are coupled to front roll 18 and front conveyor roll 82 by means of couplers 94 and 96, respectively.

Hydraulic fluid under pressure is provided to motors 90 and 92 by a pump 98. In accordance with the invention, pump 98 comprises three sections 100, 102 and 104. Section 100 provides fluid to power lifting ram 50 and other piston devices to be described in greater detail hereinafter. Section 102 provides power to conveyor motor 92 and section 104 provides power to front roll motor 90. A reservoir 106 stores fluid for the hydraulic system of the invention. A pair of supply lines 108 and 110 lead from reservoir 106 to pump 98. Power flow lines 112, 114 and 116 extend from pump 98 to the rams of the apparatus, the conveyor motor and the front roll motor, respectively. The hydraulic system further comprises return lines 118 and 120, as shown in FIG. 8. Additional return lines (not shown) return fluid from the rams to reservoir 106. A 12-volt electrically operated system, including solenoid operated valves, may be provided to control flow of fluid to respective parts of the hydraulic power system. A deisel or gasoline engine 122 is provided for operating pump 98.

A typical drive system in accordance with the present invention includes a conveyor motor 92 which develops 3017 inch pounds of torque at 2000 psi at 9.6 gallons of maximum fluid flow. Front roller motor 90 develops 1112 inch pounds of torque at 2000 psi with 4.8 gallons maximum fluid flow. Pump 98 delivers a total maximum fluid flow at 12000 RPM of 14.6 gallons of fluid flow per minute.

A hydraulic drive system in accordance with the present invention offers significant advantages over other types of drive arrangements which might be employed. The fluid flow supply and return lines of the drive system are flexible and easily accomodate the relative movement of the front roll, conveyor, etc. of the apparatus. The need for rigid mechanical connections is eliminated, along with complex and costly adjusters as would be required for such mechanical links. Installation and maintenance of a hydraulic drive system in accordance with the invention is substantially less expensive than that required for mechanical drive systems. Significant electrical currents, as would be required for electric drive motors, are not present in the apparatus whereby the danger of shock is eliminated. Additionally, fluid drive means in accordance with the invention is significantly quieter than mechanical means such as chains and gears, minimizing the amount of disturbance created by the apparatus of the invention.

An additional novel feature of the present apparatus will be described with reference to FIGS. 1 and 9–11. As briefly noted above, the inventive apparatus includes a hopper or receptacle 43 supported at a rear portion thereof. Receptacle 43 includes a frame of suitable configuration covered by mesh or expanded metal 45. Hopper 43 is supported by a pair of main support arms 124 which are pivotally attached to frame 12 by pivotal mounts 126. A pair of second support arms 128 are rigidly attached to hopper 43 and pivoted to arms 124 by pivotal mounts 130. Emptying means for hopper 43 include a pair of hopper lifting rams 132, a pair of hopper pivoting rams 134 and pivoted links 135 and 137. The operation of these elements will be described in greater detail below.

Figure 9:
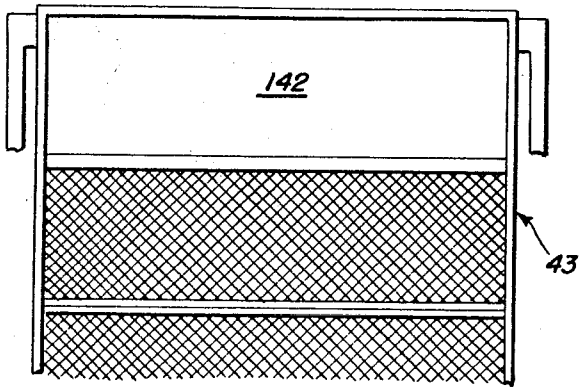
FIG. 9 is a view in the direction of arrow 9 (FIG. 10) of a receptacle associated with the invention.
Figure 11:
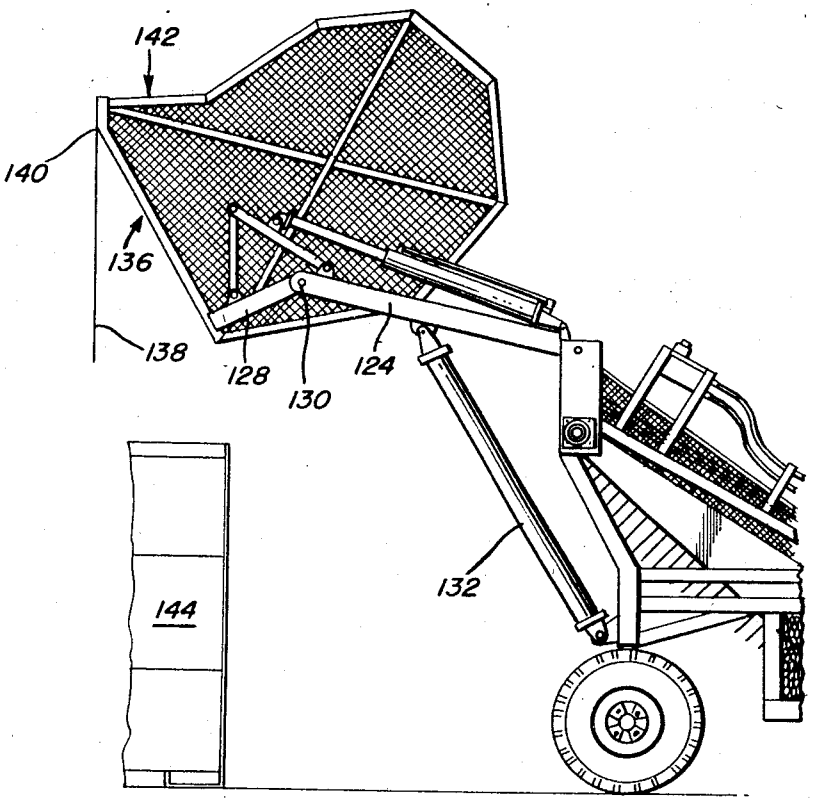
FIG. 11 is a partial view of the apparatus showing the receptacle thereof in a fully inverted position for emptying.

Hopper 43 includes an opening 136 in the top thereof, covered by a closure 138, as best seen in FIG. 11. Closure 138 is pivoted about a hinge 140. As best seen in FIG. 9, of the drawings, hopper 43 further includes another opening 142. FIG. 9 is a view of hopper 43 in the direction of arrow 9, shown in FIG. 10. Openings 142 is always open; no means are provided for closing this opening at any time.

When the apparatus of the invention is retrieving and collecting litter, hopper 43 is in the position shown in FIG. 1 of the drawings. In such position, opening 142 is adjacent the upper portion of conveyor 26 and litter carried by the conveyor is tossed into hopper 43 through opening 142.

Figure 10:
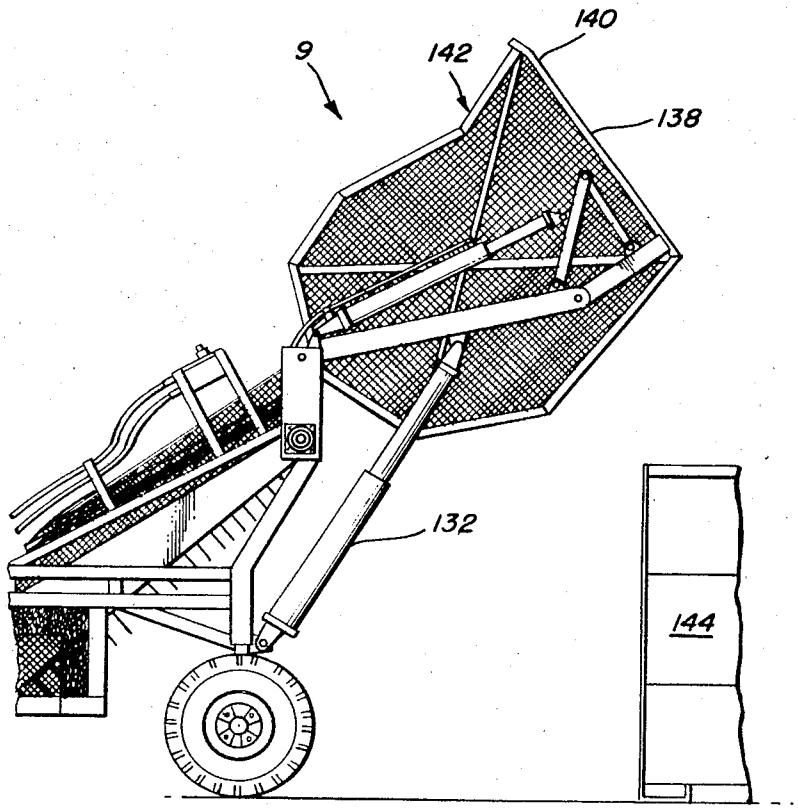
FIG. 10 is a partial view of the apparatus showing the receptacle thereof in an intermediate stage of the emptying procedure.

When it is desired to empty hopper 43, hydraulic fluid under pressure is first provided to hopper lifting rams 132, causing support arms 124 to pivot, thereby lifting the hopper. Simultaneously, hopper pivoting rams 134 are partially extended, whereby hopper 43 is rotated so that opening 142 always remains at the uppermost portion of the hopper. With hopper 43 in such a raised position, as illustrated in FIG. 10, the apparatus may be brought closely adjacent to a trash bin 144 or the like. Rams 134 may then be fully extended, inverting hopper 43. When the hopper is fully inverted, gravitational forces cause closure 138 to pivot away from opening 136, permitting the litter in hopper 43 to be dumped therefrom.

Throughout this emptying procedure, opening 142 always remains at an upper position with respect to the remainder of hopper 43. Consequently, litter will not spill from the hopper through opening 142 and no closure means are required for this opening. This reduces the cost and complexity of the apparatus. Additionally, such closure means as were required for similar prior art devices frequently jam against litter in the hopper, causing malfunction of such apparatus. The present invention overcomes such disadvantages. Consequently, a hopper 43 in accordance with the invention may be completely filled and dumped without interference of the litter, maximizing the efficiency and utility of apparatus in accordance with the invention.

While the invention has been described with reference to the accompanying Figures, it is not limited to the details shown therein as obvious modifications may be made by those of ordinary skill in the art. The invention is limited only by the claims appended hereto.

I claim:

1. Litter collection apparatus, comprising:

a support frame;

means for facilitating movement of said apparatus across a surface;

a receptacle mounted on said frame having a first opening for receiving litter;

a first roll having a plurality of litter contacting projections for contacting litter on said surface;

means for rotating said first roll;

an endless conveyor having a plurality of litter contacting second projections extending outwardly from the outer surface of said conveyor, said conveyor having a first end adjacent to said first roll and close to said surface so that said first projections on said first roll mesh with said second projections on said conveyor and a second end supported on said frame adjacent said opening in said receptacle; and means for rotating said conveyor in a direction opposite to the direction of rotation of said first roll whereby the projections on said first roll and the projections on said second roll cooperate to lift litter from said surface and said fingers on said conveyor transport litter to said receptacle.

2. Litter collection apparatus according to claim 1, wherein said receptacle is movable from a litter collecting position to an emptying position for receiving litter from said litter retrieval means, said receptacle comprising a first opening therein and a pivotal closure over said first opening, said receptacle further comprising a second opening in the upper portion of said litter retrieval means and adjacent to said first opening for receiving litter from said litter retrieval means, said opening being devoid of closure means; and further comprising emptying means for emptying said receptacle by lifting said receptacle and thereafter rotating said receptacle about a pivot axis perpendicular to the movement of said litter from said collecting position to said emptying position wherein when said receptacle is rotated to said emptying position, said pivotal closure opens by force of gravity thereby selectively causing litter in said receptacle to exit said receptacle through said first opening, said pivot axis being located near said second opening.

3. Apparatus as in claim 2, wherein said first and second openings are positioned at an uppermost portion of said receptacle when said receptacle receives litter from said retrieval means, wherein said emptying means comprises means for maintaining said second opening at an uppermost portion of said receptacle during emptying thereof.

4. Apparatus as in claim 3, wherein said emptying means comprises means for inverting said receptacle.

5. Apparatus as in claim 3, wherein said emptying means comprises means for lifting and inverting said receptacle.

6. Apparatus as in claim 2, wherein in said collecting position said first opening is located on the top of said receptacle and said movable closure is maintained over said first opening by gravitational force when said receptacle receives litter from said retrieval means, and said movable closure is moved away from said first opening by gravitational force during emptying of said receptacle.

7. Apparatus as in claim 2, wherein said emptying means comprises means for inverting said receptacle.

8. Apparatus as in claim 2, wherein said emptying means comprises means for lifting and inverting said receptacle.

9. Apparatus as in claim 2, wherein said emptying means is hydraulically operated.

10. Apparatus as in claim 2, wherein said second projections have a shaft portion and an enlarged base portion and wherein means are provided for securing said enlarged base portion to said conveyor.

11. Litter collection apparatus according to claim 1, wherein said endless conveyor transports said litter toward the rear of said apparatus to an elevated location;

wherein said receptacle is pivotally mounted on said support frame for pivotal movement about a horizontal pivot axis transverse to the direction of movement of said apparatus from a normal litter collecting position to a litter emptying position, said receptacle having a first opening in the upper portion thereof covered by a pivotal closure and a second opening in the upper forward portion thereof for receiving litter from said litter retrieval means; and emptying means for lifting and inverting said receptacle by rotating said receptacle about said horizontal pivot axis located near said second opening in a direction such that said closure on said first opening opens under the force of gravity and litter in said receptacle is emptied from said receptacle.

12. Apparatus as in claim 11, and further including means for lifting said receptacle.

13. Apparatus as in claim 11, wherein said first opening covered by said closure is larger than said second opening.

14. Apparatus as in claim 11, wherein said first opening is located adjacent to and rearward of said second opening.

15. Litter collection apparatus comprising:

a support frame;

means for facilitating movement of said apparatus across a surface;

litter retrieval means for removing litter from the surface wherein said litter retrieval means comprises a first roll having a plurality of litter contacting first projections extending therefrom and a conveyor having a plurality of litter contacting second projections extending therefrom which mesh with said first projections to remove litter from the surface, said conveyor having a first end adjacent said first roll and a second end supported on said frame;

a receptacle mounted on said frame adjacent said conveyor for receiving litter from said second end of said conveyor; and adjustable support means for adjustably mounting said litter retrieval means on said frame whereby said retrieval means may be moved toward or away from the surface, said adjustable support means comprising flexible tension means attached to said retrieval means and lifting means mounted on said frame for moving said tension means and said retrieval means.

16. Apparatus as in claim 15 wherein said adjustable support means comprising means for moving said first roll and said first conveyor end jointly toward or away from the surface.

17. Apparatus as in claim 16, wherein said adjustable support means comprises means for maintaining said first roll and said first conveyor end substantially equidistant from the surface.

18. Apparatus as in claim 17 wherein:

said first roll is carried by a carriage frame;

said conveyor is carried by a conveyor frame, wherein said conveyor frame is pivotally supported by said support frame adjacent said second conveyor end and pivotally secured to said carriage frame adjacent said first conveyor end;

said adjustable support means comprises a cable means attached at one end thereof to said carriage frame and at the other end thereof to said lifting means.

19. Apparatus as in claim 18, wherein said adjustable support means comprises means for moving said carriage frame and said first conveyor end in an arcuate path about an axis whereat said conveyor frame is supported by said support frame adjacent said second conveyor end.

20. Apparatus as in claim 19, wherein at least a portion of said cable means adjacent said carriage frame is substantially tangential to said arcuate path.

21. Apparatus as in claim 19, wherein said carriage frame and said conveyor frame adjacent said first conveyor end are supported solely by said cable means.

22. Apparatus as in claim 15, wherein said adjustable support means comprises cable means connected at one end thereof to said retrieval means and at the other end thereof to hydraulic lifting means.

23. Litter collection apparatus comprising:

a support frame;

means for facilitating movement of said apparatus across a surface;

litter retrieval means on said frame for removing litter from the surface and receptacle means on said frame for receiving litter from said retrieval means;

said litter retrieval means comprising a rotatable roll having a plurality of first projections thereon and a conveyor belt having a plurality of second projections thereon cooperable with said first projections for removing litter from the surface and conveying the litter to said receptacle, each of said second projections having a shaft and an enlarged base portion, said conveyor belt having holding members secured to a first surface thereof for holding said base portions of said second projections on said belt against said first surface.

24. Apparatus as in claim 23, wherein each holding member comprises means for holding a plurality of said second projections on said belt.

25. Apparatus as in claim 23, wherein each holding member comprises at least one aperture for accomodating at least one of said second projections, said at least one second projection comprising means cooperating with said holding means for retaining said second projection against said first surface of said belt.

26. Apparatus as in claim 23, wherein said holding members comprise apertures for accomodating said shafts and for permitting said shafts to project outwardly from said first surface of said belt.

27. Apparatus as in claim 26, wherein each holding member holds a plurality of second projections against said first surface of said belt.

28. Apparatus as in claim 23, wherein each of said holding members comprises a channel member having a plurality of apertures for receiving said second projections, said second projections each having an enlarged portion contacting said channel member, and means for securing said channel member to said belt for holding said second projections against said first surface of said belt.

29. Litter collection apparatus comprising:

a support frame;

means for facilitating movement of said apparatus across a surface;

litter retrieval means on said frame for removing litter from the surface, said retrieval means including a movable and rotatable roll having a plurality of litter contacting first projections thereon, a movable and rotatable conveyor cooperable with said roll having a plurality of litter contacting second projections thereon which mesh with said first projections, and first means for driving said roll and said conveyor;

a receptacle on said frame for receiving litter from said conveyor, means for emptying said receptacle, and second means for driving said emptying means;

hydraulic power supply means for providing power to said first and second means; and flexible hydraulic fluid lines extending between said hydraulic power supply means and said first means thereby allowing relative movement between said first means and said roll and conveyor.

30. Apparatus as in claim 29, wherein said first means comprises a roll driving motor and a conveyor driving motor, both of said motors being movable with respect to said frame, said flexible connecting means extending between said hydraulic power supply means and each of said motors.

31. Apparatus as in claim 30, wherein said hydraulic power supply means comprises a pump having separate pumping sections associated with said roll driving motor, said conveyor driving motor, and said second means, respectively.

32. Apparatus as in claim 29, wherein said first and second means are also movable relative to each other.

33. Apparatus as in claim 29 wherein said hydraulic power supply means comprises a pump having separate pumping sections associated with said first and second means, respectively.

34. Apparatus as in claim 29, wherein said hydraulic power supply means is fixedly mounted on said frame.

* * * * *